US010370929B2

(12) United States Patent
Anderson et al.

(10) Patent No.: US 10,370,929 B2
(45) Date of Patent: Aug. 6, 2019

(54) PACKER AND ASSOCIATED METHODS, SEAL RING AND FIXING RING

(71) Applicant: Tendeka B.V., Westhill, Aberdeenshire (GB)

(72) Inventors: Neil Anderson, Aberdeen (GB); Colin Mackie, Aberdeen (GB)

(73) Assignee: Tendeka B.V., Aberdeen (GB)

( * ) Notice: Subject to any disclaimer, the term of this patent is extended or adjusted under 35 U.S.C. 154(b) by 0 days.

(21) Appl. No.: 14/888,790

(22) PCT Filed: Apr. 30, 2014

(86) PCT No.: PCT/GB2014/051342
§ 371 (c)(1),
(2) Date: Nov. 3, 2015

(87) PCT Pub. No.: WO2014/177865
PCT Pub. Date: Nov. 6, 2014

(65) Prior Publication Data

US 2016/0084033 A1 Mar. 24, 2016

(30) Foreign Application Priority Data

May 3, 2013 (GB) ..... 1308067.6

(51) Int. Cl.
*E21B 23/06* (2006.01)
*E21B 33/12* (2006.01)

(52) U.S. Cl.
CPC ..... *E21B 33/12* (2013.01); *E21B 23/06* (2013.01); *E21B 33/1208* (2013.01); *E21B 33/1216* (2013.01)

(58) Field of Classification Search
CPC ..... E21B 23/06; E21B 33/12; E21B 33/1208; E21B 33/1216
See application file for complete search history.

(56) References Cited

U.S. PATENT DOCUMENTS 7,392,851 B2 * 7/2008 Brennan, III ..... E21B 33/1216 166/187
7,401,788 B2 * 7/2008 Williams ..... E21B 33/1208 277/342

(Continued)

FOREIGN PATENT DOCUMENTS

CN 2400569 Y 10/2000
CN 1594631 A 3/2005

(Continued)

OTHER PUBLICATIONS

International Search Report PCT/ISA/210 for International Application No. PCT/GB2014/051342 dated Apr. 2, 2015.

(Continued)

*Primary Examiner* — Matthew R Buck
(74) *Attorney, Agent, or Firm* — Harness, Dickey & Pierce P.L.C.

(57) ABSTRACT

A downhole seal system comprising at least one a deformable member; and at least one expandable seal; wherein the deformable member is provided proximate, adjacent, against, or fixed to the expandable seal. Optionally, the expandable seal is or comprises a swellable seal and/or the deformable member comprises or at least partially defines a seal receiving groove and at least part of the expandable seal is received or receivable within the seal receiving groove such that the expandable seal is expandable so as to deform the deformable member and thereby increase an outer diameter or extent of the deformable member. Also described is an associated deformable member and fixing member and associated methods for producing and using the seal system.

21 Claims, 5 Drawing Sheets

(56) References Cited

U.S. PATENT DOCUMENTS

| | | | | |
|---|---|---|---|---|
| 7,874,354 | B2 * | 1/2011 | Freyer | E21B 33/1216 166/134 |
| 7,938,176 | B2 * | 5/2011 | Patel | E21B 33/1216 166/187 |
| 8,141,626 | B2 * | 3/2012 | Freyer | E21B 33/1216 166/134 |
| 8,561,689 | B2 * | 10/2013 | Nutley | E21B 33/1208 166/179 |
| 2002/0195739 | A1 * | 12/2002 | Bagley | E21B 33/1216 264/176.1 |
| 2003/0209861 | A1 * | 11/2003 | Keene | E21B 33/1212 277/603 |
| 2003/0209862 | A1 * | 11/2003 | Keene | E21B 33/1212 277/607 |
| 2006/0186601 | A1 * | 8/2006 | Lopez | E21B 33/12 277/327 |
| 2007/0151724 | A1 | 7/2007 | Ohmer et al. | |
| 2009/0139707 | A1 * | 6/2009 | Berzin | E21B 33/1208 166/118 |
| 2010/0288486 | A1 * | 11/2010 | Kutac | E21B 33/1277 166/118 |
| 2011/0088892 | A1 | 4/2011 | Freyer | |
| 2012/0018143 | A1 * | 1/2012 | Lembcke | E21B 33/1208 166/134 |
| 2013/0048271 | A1 | 2/2013 | VanLue | |
| 2013/0048272 | A1 | 2/2013 | VanLue | |
| 2013/0048313 | A1 | 2/2013 | VanLue | |
| 2013/0048314 | A1 | 2/2013 | VanLue | |
| 2013/0048315 | A1 | 2/2013 | VanLue | |
| 2014/0231069 | A1 | 8/2014 | VanLue | |

FOREIGN PATENT DOCUMENTS

| | | | |
|---|---|---|---|
| CN | 201474655 | U | 5/2010 |
| CN | 201908615 | U | 7/2011 |
| CN | 102337855 | A | 2/2012 |
| EA | 10849 | | 12/2008 |
| EP | 2246522 | A2 | 11/2010 |
| EP | 2410120 | A2 | 1/2012 |
| GB | 2427420 | A | 12/2006 |
| RU | 43582 | U1 | 1/2005 |
| RU | 108095 | U1 | 9/2011 |
| SU | 1758207 | A1 | 8/1992 |
| WO | WO-2008154392 | A1 | 12/2008 |
| WO | WO-2009073531 | A1 | 6/2009 |
| WO | WO-2011020987 | A2 | 2/2011 |
| WO | WO-2013028801 | A1 | 2/2013 |

OTHER PUBLICATIONS

Written Opinion of the International Searching Authority PCT/ISA/237 for International Application No. PCT/GB2014/051342 dated Apr. 2, 2015.

Office Action for corresponding Chinese Application No. 2014800315300 dated Feb. 21, 2017 and English translation thereof.

Office Action for corresponding Russian Application No. 2015151588 dated Mar. 28, 2018 and English translation thereof.

* cited by examiner

PACKER AND ASSOCIATED METHODS, SEAL RING AND FIXING RING

CROSS-REFERENCE TO RELATED APPLICATIONS

This application is a national phase under 35 U.S.C. 517 371 of PCT International Application No. PCT/GB2014/051342 which has an International filing date of Apr. 30, 2014, which claims priority to United Kingdom No. GB 1308067.6, filed May 3, 2013, the entire contents of each of which are hereby incorporated by reference.

FIELD OF THE INVENTION

The present invention relates to a seal system such as a packer/slide on sleeve, a seal ring for a packer, a fixing ring for a packer and associated methods of manufacture and use.

BACKGROUND OF THE INVENTION

Downhole packers are commonly used downhole in applications such as isolating zones in a wellbore. Such packers may comprise swellable components that swell under the action of fluid in the well bore to form a seal between a pipe to which it is attached and the inside diameter of the wellbore or bore casing.

The seal quality of the packer is an important factor in packer design. Improving the seal quality can allow the packer to operate at and withstand higher pressures or allow a shorter packer to be used at the same differential pressure.

Patent documents US 2011/0088892A1, GB 2427420A, US 2010/0288486A1, WO 2011/020987A2, and EP 2246522A3 suggest the use of an intermediate member between an end ring and a seal in order to improve the quality of the seal.

SUMMARY OF THE INVENTION

According to a first aspect of the invention is a downhole seal system, such as a packer or slip on sleeve. The seal system may be configured to be mounted on a pipe or other elongate structure. The seal system may be configured to seal between the pipe or other structure and walls or casing of a hole, conduit or borehole in which the seal system is located.

The seal system may comprise at least one and preferably two (i.e. first and second) end members.

The seal system may comprise at least one seal, which may be configured to seal against the walls or casing of the hole, conduit or borehole in which the seal system is located. The seal may be at least partially disposed between the end members. At least part of at least one and preferably each end of the seal may be provided proximate, adjacent or in contact with or fixed to a respective end member.

The end members may comprise cylindrical or annular members. The end members may comprise inner and outer surfaces. The inner surface may at least partially define a passage having openings at opposing ends of the end member. The passage may be configured to receive the pipe or other structure upon which the seal system is mountable.

The seal may be annular and/or cylindrical. The seal may at least partially define a through passage, which may be for receiving the pipe or other structure upon which the seal system is mountable. The seal may comprise an expandable seal such as a swellable seal. The swellable seal may be selectively or preferentially swellable in selected fluids, which may comprise fluids found downhole, such as oil and/or water or wet gas. The expandable seal may be swellable or expandable to seal against the walls or casing of the hole, conduit or borehole when swollen.

The passages of the end members and the seal may be aligned to form a through passage of the seal system configured to receive the pipe or other structure upon which the seal system is mountable. In this way, the seal system may be in the form of a sleeve for mounting on the pipe or other structure.

The seal device may comprise at least one deformable member, such as a seal ring. At least one deformable member may be comprised in at least one and preferably each of the end members. The deformable member may comprise an annular member or ring. The deformable member may comprise or be formed from a non-metallic material such as an elastomeric material, such as PTFE, Viton, a hydrogenated nitrile compound such as hydrogenated nitrile butadiene rubber (HNBR), highly saturated nitrile (HSN) or the like.

The deformable member may be provided adjacent, proximate, against, fixed to or embedded in the seal.

The deformable member may comprise or at least partially define a seal receiving groove or recess which may comprise a concave groove or recess. The seal receiving groove may be provided on a surface of the deformable member, such as a side surface. In particular, the seal receiving groove may be provided on a surface of the deformable member that faces the seal.

The seal receiving groove may comprise a substantially V-shaped groove. The seal receiving groove may be at least partially defined by at least one leg, such as an upper or outer leg, and preferably by at least two opposing legs. The opposing legs may comprise the upper or outer leg and a lower or inner leg, wherein the upper or outer leg is provided radially outwardly of the lower or inner leg. The upper or outer leg may comprise the leg furthest from the pipe or through passage, whilst the lower or inner leg may comprise the leg closest to the pipe or through passage.H The seal receiving groove may be asymmetric in cross section. One of the legs may have a different radius of curvature to the other leg. One of the legs, which may be the upper or outer leg, may extend further from the body of the deformable member than the other leg (e.g. the lower or inner leg). This may allow the upper or outer leg to bridge a larger gap between the end member and the wall of the bore, conduit or casing.

One of the legs (which may be the upper or outer leg) or a face thereof may extend at a different angle to the other leg (e.g. the lower or inner leg) or a face thereof. One of the legs (which may be the upper or outer leg) or a face thereof may extend at a smaller angle to the horizontal than the other leg (e.g. the lower or inner leg) or a face thereof. For example, the outer leg or a face thereof may extend at an angle to the horizontal that is between 20 and 70% greater than the angle to the horizontal at which the lower leg or a face thereof extends. In a more specific example, the upper leg or a face thereof may extend at between 10° and 30° above horizontal, whilst the lower leg or a face thereof may extend between 20° and 40° below horizontal.

The end member may comprise a fixing member such as an end ring. The deformable member may be mounted on or adjacent to the fixing member. The fixing member may be annular. The fixing member may be rigid. The fixing member may be metallic.

The end member may be configured such that the fixing member abuts or is adjacent or fixed to the deformable member.

The fixing member may comprise a recess, such as a concave recess, for at least partially receiving the deformable member. The recess may comprise a groove, which may be in the form of a substantially v-shaped groove. The recess may open by an angle of between 50° and 100°, preferably between 60° and 90° and most preferably between 70° and 80°.

A surface of the deformable member that faces the fixing member, which may be a surface opposite the surface of the deformable member on which the seal receiving recess is provided, may be shaped to fit into the recess of the fixing member, for example by comprising a protruding profile, which may comprise a complimentary profile to that of the recess. The deformable member may have a cross section in the form of a chevron or a distorted or asymmetrical chevron.

The fixing member may be fixed or fixable to the pipe or other structure. The fixing member may comprise one or more fixing elements, such as set or grub screws, for selectively fixing the fixing member to the pipe or other structure.

At least part of at least one and preferably each end of the seal may be outwardly protruding or beveled so as to at least partially extend into the seal receiving groove of the deformable member and may extend at least partially between the legs of the deformable member.

The seal system may be configured such that as the seal expands, the seal applies a force to the opposing legs of the seal receiving groove of the deformable member so as to deform the deformable member, which may comprise pushing the opposing legs apart. The expansion of the seal may apply a force that acts to push the upper or outer leg of the seal receiving recess of the deformable member radially outwardly. The seal system may be configured such that deformation of the deformable member due to expansion of the seal may increase the outer diameter or extent of the deformable member. In this way, as the seal expands, the expansion of the seal may apply pressure on the legs of the deformable member that may force the opposing legs apart so as to increase the outer diameter or extent of the deformable member. This in turn may act to close any gaps between the deformable member and surfaces of the bore wall, casing or conduit in which the seal system is located. As a result, the deformable member may be operable as an additional or back-up seal. The deformable member may also help to guide the swelling or expansion of the seal radially outwardly, may support the seal and may prevent extrusion of the seal through gaps between the end members and the bore wall, casing or conduit, particularly under high pressure differentials or flow often found downhole, particularly in deep bores.

Furthermore, this configuration may allow a greater tolerance or clearance between the outer diameter of the end members in an initial state (i.e. when the seal is unswollen or unexpanded) and the inner diameter of the bore, casing or conduit. Thereby, the device may be easier to insert into place without getting stuck but at the same time suitably inhibit extrusion of the outer seal when the seal is expanded and the deformable member has been deformed. This may facilitate a higher expansion ratio of the seal(s) and allow easier insertion of the seal device past restrictions and narrow portions of the bore or conduit without jamming.

The improved sealing quality that results from this configuration may allow a shorter packer length to be used for similar sealing performance to that of a larger conventional packer or may allow higher operational pressures at a similar length of packer to be achieved.

According to a second aspect of the present invention a deformable member is provided for use with a seal system, such as the seal system of the first aspect. The deformable member may comprise an annular member or ring. The deformable member may comprise or be formed from a non-metallic material such as an elastomeric material, for example, PTFE, Viton, HNBR or the like. The deformable member may be operable as a seal ring, such as a secondary or back-up seal ring. The deformable member may comprise a seal receiving groove, such as a concave groove. The seal receiving groove may be an annular groove. The seal receiving groove may be provided on a surface of the deformable member, such as a side surface.

The seal receiving groove may comprise a substantially V-shaped groove. The seal receiving groove may be partially defined by at least two opposing legs. The opposing legs may comprise an upper or outer leg and a lower or inner leg, wherein the upper or outer leg is provided radially outwardly of the lower or inner leg. The seal receiving groove may be asymmetric in its cross section. One of the legs may have a different radius of curvature to the other leg. One of the legs, which may be the upper or outer leg, may extend further from the body of the elastomeric member than the other leg (e.g. the lower or inner leg). One of the legs (which may be the upper or outer leg) or a face thereof may extend at a different angle to the other leg (e.g. the lower or inner leg) or a face thereof. One of the legs (which may be the upper or outer leg) or a face thereof may extend at a lower angle to the horizontal than the other leg (e.g. the lower or inner leg) or a face thereof. For example, the outer leg or a face thereof may extend at an angle to the horizontal that is between 20 and 70% greater than the angle to the horizontal at which the lower leg or a face thereof extends. In a more specific example, the upper leg or a face thereof may extend at between 10° and 30° above horizontal, whilst the lower leg or a face thereof may extend between 20° and 40° below horizontal.

A surface of the deformable member opposite the surface on which the seal receiving recess is provided may comprise a protruding profile. The deformable member may have a cross section in the form of a chevron or a distorted chevron. According to a third aspect of the present invention a fixing member is provided for use in a seal system, such as the seal system of the first aspect.

The fixing member may comprise or form an end ring.

The fixing member may comprise an annular member. The fixing member may comprise or form an end ring. The fixing member may be rigid. The fixing member may be metallic.

The fixing member may comprise a recess for at least partially receiving a deformable member. The recess may be provided on a side surface of the fixing member. The recess may comprise a substantially v-shaped groove. The recess may open by an angle of between 50° and 100°, preferably between 60° and 90° and most preferably between 70° and 80°.

According to a fourth aspect of the present invention is a method for producing a seal system, such as the seal system of the first aspect. The method may comprise providing a deformable member according to the second aspect. The method may comprise providing a fixing member according to the third aspect proximate or adjacent or fixed to or butting against the deformable member. The method may comprise providing the protruding profile of the deformable member at least partially within the recess of the fixing member.

The method may comprise providing an expandable seal, such as a swellable seal, proximate or adjacent to or butting against or fixed to or comprising the deformable member. The deformable member may be provided between the fixing member and the seal. The method may comprise providing a part of the seal between opposing legs of the deformable member.

According to a fifth aspect of the present invention is a method for using a seal system, such as the seal system according to the first aspect. The method may comprise mounting the seal system to the pipe or other structure, such that at least a portion of the pipe or other structure is received within a passageway or annulus of the seal system. The method may comprise providing fluid to the seal so as to swell the seal. The seal may be swollen to seal against a bore wall or casing or conduit in which the seal system is located.

The method may comprise deforming the deformable member by swelling or expanding the seal such that the swelling or expanding of the seal acts to deform the deformable member. The method may comprise deforming the deformable member so as to increase the outer diameter or extent of the deformable member. The method may comprise swelling or expanding a portion of the seal that is provided between legs of the deformable member. The seal may be swollen or expanded so as to exert a force on at least one leg and preferably both legs.

It will be appreciated that features analogous to those described above in relation to any of the above aspects may be individually and separably or in combination applicable to any of the other aspects.

Apparatus features analogous to those described above in relation to a method and method features analogous to the use and construction of those described above in relation to an apparatus are also intended to fall within the scope of the present invention.

BRIEF DESCRIPTION OF THE DRAWINGS

Embodiments are now described, by way of non-limiting example, and are illustrated in the following figures, in which.

DETAILED DESCRIPTION OF THE DRAWINGS

Figure 1:
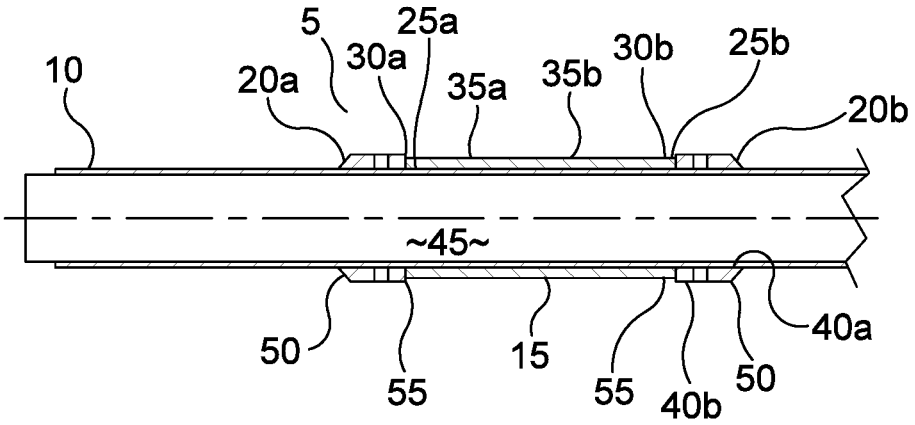
FIG. 1 shows a longitudinal cross sectional view of a seal system mounted in situ to a pipe.

FIG. 1 shows a seal system 5 according to an embodiment of the present invention mounted on a pipe 10. The seal system 5 comprises a swellable seal 15 provided between a pair of end members 20*a*, 20*b*. In this particular embodiment, the seal 15 is bonded to the pipe 10 and both end members 20*a*, 20*b*. The seal system 5 is configured such that opposite ends 25*a*, 25*b* of the swellable seal 15 are bonded to corresponding faces 30*a*, 30*b* of the end members 20*a*, 20*b*. The end members 20*a*, 20*b* are also fixed to the pipe 10, for example, by bonding, grub screws and/or the like.

The swellable seal 15 is in the form of a cylindrical sheath comprising inner and outer surfaces 35*a*, 35*b*, wherein the ends 25*a*, 25*b* of the seal extend between the inner and outer surfaces 35*a*, 35*b*. The inner surface 35*a* defines a longitudinal through passage that is open at either end of the seal 15. The swellable seal 15 comprises a suitable material that is selectively or preferentially swellable by specific fluids, which optionally comprise fluids found downhole, such as oil and/or water or wet gas. The swellable seal 15 comprises, for example, a suitably swellable rubber or the like.

The end members 20*a*, 20*b* comprise cylindrical members having inner and outer surfaces 40*a*, 40*b*, the inner surface 40*a* defining a through passage that is open at either end of the end member 20*a*, 20*b*. The through passages of the end members 20*a*, 20*b* and the swellable seal 15 align to form a longitudinal passage 45 through the seal system 5 that is adapted to receive or accommodate the pipe 10, such that the seal system 5 forms a sheath that can be mounted on the pipe 10.

Figure 2:
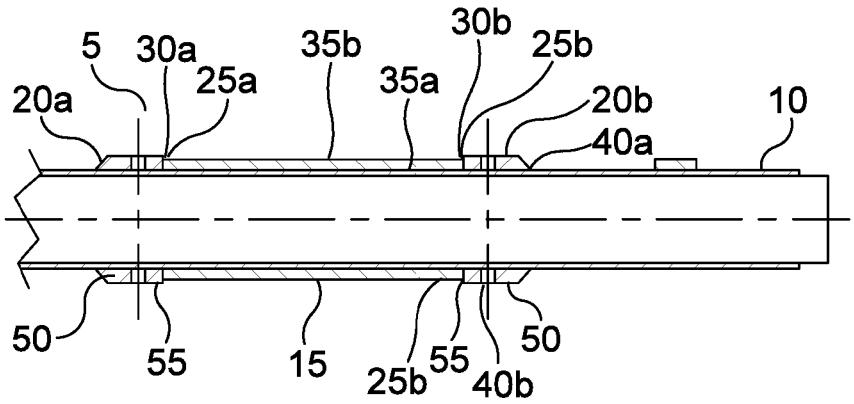
FIG. 2 shows a longitudinal cross sectional view of an alternative seal system mounted in situ on a pipe.

FIG. 2 shows an alternative embodiment of a seal system 5' in situ, mounted on a pipe 10. The seal system 5' of FIG. 2 is similar to that of FIG. 1 and like components are indicated with corresponding reference numerals. However, whereas the swellable seal 15 of the embodiment of FIG. 1 is bonded to both the pipe 10 and the end members 20*a*, 20*b*, the swellable seal 15 of the seal system 5' of FIG. 2 is only bonded to the pipe 10 and is free to move in relation to the end members 20*a*, 20*b*. Particularly, opposite ends 25*a*, 25*b* of the seal 15 are simply provided against, adjacent or proximate the corresponding faces 30*a*, 30*b* of the end members 20*a*, 20*b* rather than being bonded to them.

In each of the above embodiments, the end members 20*a*, 20*b* each comprise a rigid fixing member, for example in the form of an annular end ring 50, and a deformable member 55, for example in the form of an annular elastomeric or non-elastomeric ring. The end members 20*a*, 20*b* are configured such that the deformable member 55 is provided between the end ring 50 and the swellable seal 15 such that the deformable member 55 forms at least part of the side face 30*a*, 30*b* of the end member 20*a*, 20*b* that faces the swellable seal 15.

Figure 3:
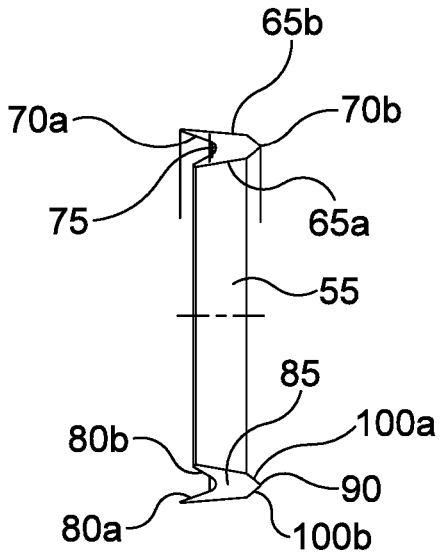
FIG. 3 shows a longitudinal cross sectional view through a deformable member for a seal system.
Figure 4:
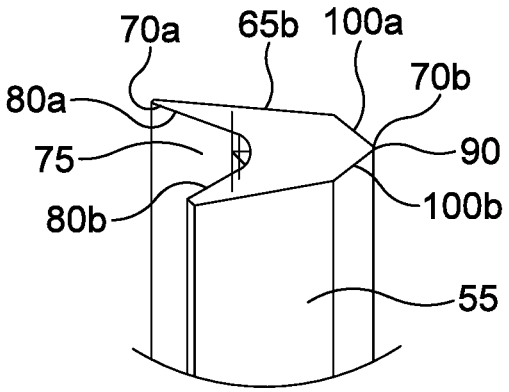
FIG. 4 shows a detail view of the cross section of the deformable member shown in FIG. 3.
Figure 5:
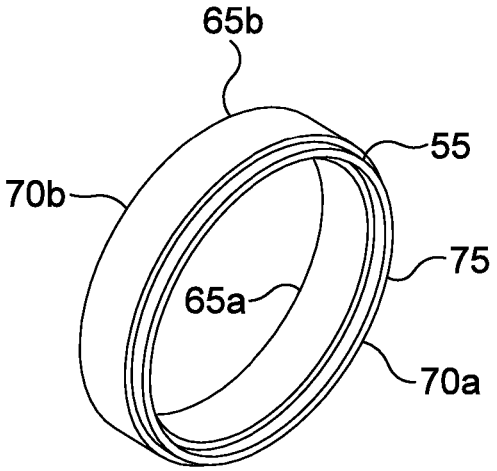
FIG. 5 shows a perspective view of the deformable member shown in FIG. 3.

The deformable member 55 is shown in more detail in FIGS. 3, 4 and 5. In particular, the deformable member 55 comprises inner and outer surfaces 65*a*, 65*b* and first and second sides 70*a*, 70*b* extending between the inner and outer surfaces 65*a*, 65*b*. The first side 70*a* of the deformable member 55 faces the seal 15 whilst the second side 70*b* of the deformable member 55 faces the end ring 50. The inner surface 65*a* of the deformable member 55 defines a through passage that forms part of the longitudinal passage 45 through the seal system 5, 5' that receives the pipe 10.

The first side 70*a* of the deformable member 55 comprises a seal receiving groove in the form of an annular groove 75 that extends around the first side 70*a* of the deformable member 55. The groove 75 is defined by first and second opposed legs 80*a*, 80*b*, the first leg 80*a* being provided radially outwardly of the second leg 80*b* (i.e. further from the passage 45).

The groove 75 has an asymmetric cross sectional profile, with the first (i.e. the outer ward) leg 80*a* being longer and extending further from the body of the deformable member 55 than the second leg 80*b*. In addition, the first leg 80*a* is provided at a shallower angle to the horizontal 85 relative to the second leg 80*b*.

In various embodiments, the first leg 80*a* may extend at an angle to the horizontal that is between 20% and 100% greater than the angle to the horizontal at which the second leg 80*b* extends. In a more specific example, the first leg 80*a* may extend at between 10° and 30° above horizontal, whilst the second leg 80*b* may extend between 20° and 40° below horizontal. In the specific non-limiting example shown in FIG. 4, the first leg 80*a* is angled at 20° above the horizontal, whilst the second leg 80*b* is angled at 30° below the horizontal. In various embodiments, the first leg 80*a* can extend between 2 mm and 30 mm beyond the second leg 80*b* (in an undistorted state), and preferably between 3 mm and 9 mm beyond. In the specific embodiment shown in FIG. 4, the first leg 80*a* extends 5.8 mm (0.23 inches) beyond the second leg 80*b*. The apex of the V-shaped groove 75 is radiused.

The second side 70*b* of the deformable member comprises a protruding portion 90 that is configured to fit into a receiving recess 95 in the end ring 50. The protruding portion 90 comprises a v-shaped protrusion. In certain embodiments, the surfaces 100*a*, 100*b* of the deformable member 55 that form the v-shaped protrusion 90 are subtended by an angle of between 50° and 100° and preferably between 65° and 85°.

In the specific embodiment shown in FIG. 4, the surfaces 100*a*, 100*b* of the deformable member 55 that form the v-shaped protrusion 90 are subtended by an angle of 76°.

Although various dimensions and angles of the deformable member 55 in the undeformed state are described above, it will be appreciated that at least some of the dimensions and angles of the deformable member 55 will be varied depending on the application, e.g. depending on the diameter of pipe 10 upon which the seal system 5, 5' is to be mounted, the diameter of the bore or conduit into which it is to be placed, the thickness of the seal 15, the seal quality required, and the like. As such, the above dimensions and angles are merely preferable and are not intended to be exhaustive.

The inner and outer surfaces 65*a*, 65*b* of the deformable member 55 are angled divergently from the second side 70*b* to the first side 70*a*. In particular, the deformable member 55 comprises a generally chevron or distorted chevron shaped cross section.

Figure 6:
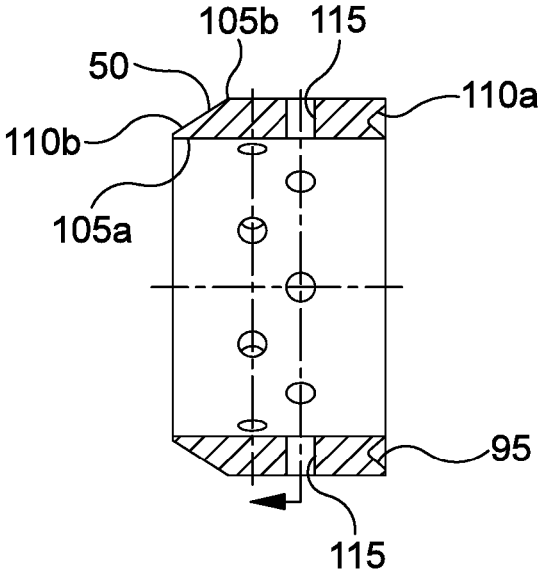
FIG. 6 shows a longitudinal cross section through a fixing member for a seal system.
Figure 7:
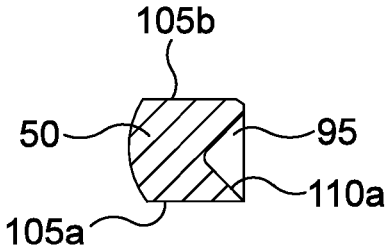
FIG. 7 shows a detail view of the cross section through the fixing member shown in FIG. 5.
Figure 8:
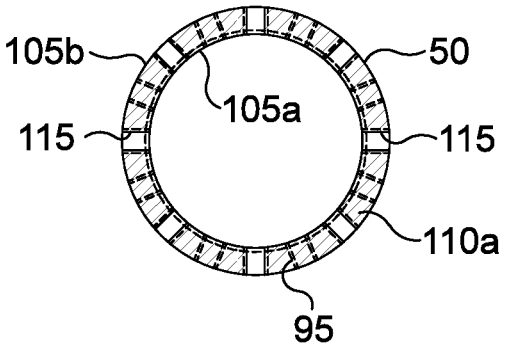
FIG. 8 shows a transverse cross section through the fixing member shown in FIG. 6.
Figure 9:
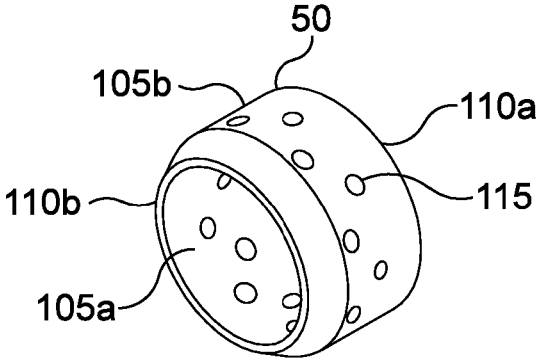
FIG. 9 shows a perspective view of the fixing member shown in FIG. 6.

The end ring 50 is shown in more detail in FIGS. 6 to 9. FIG. 6 shows a cross section through the end ring 50, whilst FIG. 7 shows more detail of the recess 95. FIG. 8 shows the end ring 50 in a transverse cross section and FIG. 9 shows a perspective view of the end ring 50. The end ring 50 comprises an annular member having outer and inner surfaces 105*a*, 105*b* and first and second sides 110*a*, 110*b* disposed between the inner and outer surfaces 105*a*, 105*b*. The first side 110*a* of the end ring faces toward the deformable member 55 and the second side 110*b* of the end ring 50 forms an outer end of the seal system 5, 5'. The inner surface 105*a* of the end ring 50 defines a through passage that partially forms the passage 45 through the seal system 5, 5' in which the pipe 10 is received in order to mount the seal system 5, 5' in use.

The end ring 50 is provided with fixing means 115 for fixing the end ring 50 on the pipe 10. In various embodiments, the fixing means 115 can comprise the provision of suitable bonding between the end ring 50 and the pipeline 10 and/or a plurality of threaded apertures for receiving set or grub screws that can be tightened so as to bear against the pipe 10 to thereby fix the seal system 5, 5' in place.

The first side 110*a* of the end ring 50 (i.e. the side that faces the deformable member 55) comprises the receiving recess 95 for receiving the protruding portion 90 of the deformable member 15. The recess 95 is in the form of an annular groove that runs around the first side 110*a* of the end ring 50. The recess 95 has a generally v-shaped cross section, as shown in FIGS. 6 and 7. The apex of the recess 95 is radiused. The recess 95 is configured to open with an angle greater than the corresponding angle of the protrusion 90 of the deformable member 55. In this example, the recess 95 is subtended by a 90° angle. In other embodiments, the recess 95 may be subtended by an angle between 60° and 120°.

Figure 10:
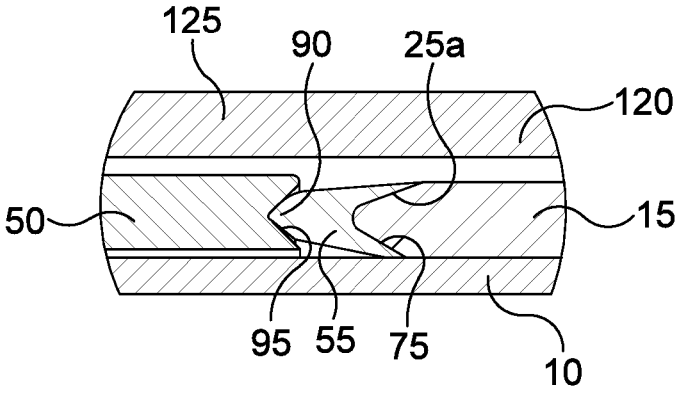
FIG. 10 shows a detail view of part of a seal system in an initial or unswollen state.

As can be seen from FIG. 10, in an initial, unswollen state, the ends 25*a* of the swellable seal 15 is beveled or comprises a protruding portion such that at least a portion of the side 25*a* of the seal 15 can be received within the groove 75 of the deformable member 55 between the opposing legs 80*a*, 80*b*. The other end 25*b* of the swellable seal (not shown) may also be beveled.

In the unswollen state, the seal member 15 is sized such that a gap 120 is left between the seal member 15 and the walls 125 of the bore, casing or conduit in which the seal system 5, 5' and pipe is inserted in order to permit easy insertion of the seal system 5, 5'. Once the seal system 5, 5' is located in the desired location, a suitable fluid that results in swelling of the swellable seal 15 is provided to the swellable seal 15 through the bore, casing or conduit.

Figure 11:
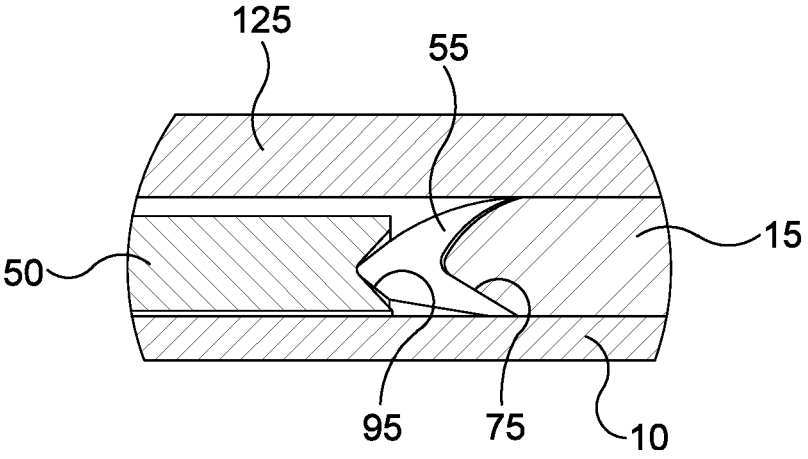
FIG. 11 shows a detail view of part of a seal system in an operational or swollen state.

The resulting swelling of the swellable seal 15 closes the gap 120 between the swellable seal 15 and the wall 125 of the bore, conduit or casing. In addition, the swelling of the seal 15 applies pressure on the opposing legs 80*a*, 80*b* of the groove 75 of the deformable member 55. This has the effect of deforming the deformable member 55 by forcing the legs 80*a*, 80*b* apart. As a result, the outer diameter of the deformable member 55 expands. Specifically, the first leg 80*a* is pushed outwardly towards and into contact with the wall 125 of the bore, casing or conduit, as can be seen in FIG. 11. As a result, the gap 120 between the end members 20*a*, 20*b* and the wall 125 of the bore, casing or conduit is substantially eliminated or at least greatly reduced. In this way, the deformable member acts as a back-up or additional seal.

Furthermore, extrusion of the swellable seal 15 past the end members 20*a*, 20*b* due to pressure differentials or flow found downhole is substantially reduced or eliminated. In this way, the deformable member 55 acts as an anti-extrusion ring. Furthermore, since the deformable member 55 is formed from a non-metallic material, it has enough give to minimise the risk of the deformable member 55 causing the seal system 5, 5' to stick in the hole but has enough strength to provide additional support to the swellable seal 15, biasing the seal 15 into an optimal position and providing additional or back-up sealing between the pipe 10 and the walls of the borehole, conduit or casing. In this way, improved seal quality can be obtained, which may permit the use of the seal system 5, 5' with higher pressure differentials or alternatively, may permit the use of a shorter seal system at a similar pressure range. The shape of the deformable member 55 is such that the longer first leg 80*a* allows the gap 120 to the wall 125 of the conduit, bore or casing to be more reliably bridged.

Furthermore, the shape of the deformable member 55 is such that the higher the pressure that is applied to the legs 80*a*, 80*b*, the more forcefully the second leg 80*b* is forced against the pipe 10 and the first leg 80*a* is forced against the wall 125 of the bore, conduit or casing. As such, the higher the pressure that is applied, the tighter the seal that is formed by the deformable member 55, thereby permitting use at a higher operating pressure differentials. By providing the recess 95 in the end ring 50, the deformable member 55 can be more securely located and additional support is provided to the deformable member 55 whilst allowing the deformable member 55 to suitably flex and deform.

While certain embodiments have been described, these embodiments have been presented by way of example only, and are not intended to limit the scope of the invention. Indeed the novel methods and systems described herein may be embodied in a variety of other forms. Furthermore, various omissions, substitutions and changes in the form of the methods and systems described herein may be made without departing from the spirit of the invention. The accompanying claims and their equivalents are intended to cover such forms and modifications as would fall within the scope of the invention.

For example, whilst certain preferential dimensions and angles are described herein, it will be appreciated that the size and angles of the components of the seal system 5, 5' will vary depending on the application, e.g. with the size of the pipe, the size of the bore or conduit and the like.

In addition, embodiments have been described herein wherein the seal receiving recess is advantageously in the form of a groove defined between first and second legs of the deformable member. This arrangement has advantages such as improved sealing since pressure applied to the first and second legs by the swellable member acts to force one leg into contact with the pipe and the other leg into contact with the wall or casing of the bore, conduit or hole. However, it will be appreciated that other configurations may be used. For example, the swellable member may be adhered, bonded or otherwise fixed to the pipe and the swellable member may only be provided with one leg (e.g. the upper or outer leg), such that the recess is defined by the leg of the deformable member and the surface of the pipe. In this way, the swelling of the seal acts to push the single leg radially outwardly in order to close the gap between the deformable member and the wall of casing of the bore, conduit or hole.

Furthermore, whilst various components of the seal system 5, 5' are described as being constructed of certain materials, it will be appreciated that the components may be fabricated from other suitable materials.

In addition, whilst the seal system 5, 5' is described as being mountable on a pipe 10, it will be appreciated that the seal system is also mountable to other structures such as mandrels, cables, struts, and the like.

Whilst the above examples have been described in relation to the seal system 5, 5' being used in a bore, it will be appreciated that the seal system may also be used in other locations, such as in casings, conduits, holes, channels and the like. In addition, whilst the seal receiving recess 75 in specific embodiments is advantageously a groove, it will be appreciated that other shapes or forms of recess could also be used.

Furthermore, whilst the seal 15 is described as being advantageously swellable, it will be appreciated that other seals, such as expandable seals, that are expandable or movable in order to deform the deformable member could be used. Examples of such alternative seals may include inflatable or pressurizable seals, seals that comprise a compressed resilient material that are expandable when released and the like.

The invention claimed is:

1. A downhole seal system comprising:

a deformable member including a body and first and second legs extending axially from the body, the first leg provided radially outwardly of the second leg to define an annular seal receiving groove radially between the first and second legs;

an expandable seal including an end portion received within the annular seal receiving groove, the expandable seal being expandable so as to deform the deformable member and increase a radial separation of at least portions of the first and second legs; and a fixing member configured to be fixed relative to the deformable member so as to securely locate the deformable member in the seal system, the fixing member comprising a recess for at least partially receiving the deformable member.

2. The seal system according to claim 1, wherein the expandable seal is a swellable seal.

3. The seal system according to claim 1, wherein the seal system comprises first and second fixing members, the deformable member being within the first fixing member and a further deformable member being within the second fixing member, at least part of the expandable seal being provided axially between the fixing members.

4. The seal system according to claim 1, wherein the expandable seal is adapted for sealing against walls or casing of a hole, conduit or borehole in which the seal system is located when the seal is swollen.

5. The seal system according to claim 1, wherein the deformable member comprises a non-metallic material.

6. The seal system according to claim 1, wherein the annular seal receiving groove is asymmetric in cross section.

7. The seal system according to claim 1, wherein one of the first and second legs extends axially further from the body of the deformable member than the other of the first and second legs.

8. The seal system according to claim 1, wherein the deformable member is provided between the fixing member and the expandable seal.

9. The seal system according to claim 1, wherein the fixing member is configured to be fixed to a pipe or other structure upon which the seal system is mounted.

10. The seal system according to claim 1, wherein a surface of the deformable member that faces the fixing member comprises a protruding profile shaped to fit into the recess of the fixing member.

11. The seal system according to claim 1, wherein the deformable member has a cross section in the form of a chevron or a distorted or asymmetric chevron.

12. The seal system according to claim 1, wherein the end portion of the expandable seal has a profile which corresponds to the profile of the annular seal receiving groove of the deformable member.

13. The seal system according to claim 1, wherein the seal system is configured such that as the expandable seal expands, the expandable seal applies a radially outward force to the first leg of the deformable member and a radially inwardly force to the second leg of the deformable member.

14. The seal system according to claim 1, wherein the deformable member comprises a non-metallic ring.

15. The seal system according to claim 1, wherein the annular seal receiving groove is at least partially defined between the first and second legs and one of the first and second legs extends further from the body of the deformable member than the other of the first and second legs.

16. The seal system according to claim 1, wherein a surface of the deformable member opposite a surface on which the seal receiving groove is provided comprises a protruding profile.

17. The seal system according to claim 1, wherein the fixing member is rigid and configured to be fixed to a pipe or other structure upon which the seal system is mounted.

18. The seal system according to claim 1, wherein one of the first and second legs extends from the body of the deformable member at a different angle to the other of the first and second legs.

19. A method for producing the seal system according to claim 1, the method comprising providing the deformable member having the annular seal receiving groove between the fixing member and the expandable seal, wherein the fixing member is rigid and configured to be fixed to a pipe or other structure upon which the seal system is mounted.

20. The method according to claim 19, comprising providing a part of the expandable seal within the annular seal receiving groove in the deformable member.

21. A method for using the seal system according to claim 1, the method comprising:

mounting the seal system to a pipe or other structure, such that at least a portion of the pipe or other structure is received within a passageway of the seal system; and expanding the expandable seal of the seal system to deform the deformable member so as to increase at least one of an outer diameter or an extent of the deformable member.

* * * * *